US006168089B1

(12) United States Patent
Dupre

(10) Patent No.: US 6,168,089 B1
(45) Date of Patent: Jan. 2, 2001

(54) SNOW MAKING TOWER WITH ANTIFREEZE PRECOOLING SYSTEM

(76) Inventor: Herman K. Dupre, c/o Seven Springs, Champion, PA (US) 15622

( * ) Notice: Under 35 U.S.C. 154(b), the term of this patent shall be extended for 0 days.

(21) Appl. No.: 09/487,478

(22) Filed: Jan. 19, 2000

(51) Int. Cl.[7] ..... F25C 3/04
(52) U.S. Cl. ..... 239/14.2
(58) Field of Search ..... 239/14.2, 2.2

(56) References Cited

U.S. PATENT DOCUMENTS

| | | | | |
|---|---|---|---|---|
| 3,464,625 | | 9/1969 | Carlsson | 239/2 |
| 3,733,029 | | 5/1973 | Eustis et al. | 239/14 |
| 3,761,020 | | 9/1973 | Tropeano et al. | 239/2 |
| 3,762,176 | * | 10/1973 | Coggins, Jr. | 239/14.2 |
| 3,831,844 | | 8/1974 | Tropeano et al. | 239/14 |
| 4,889,180 | | 12/1989 | Sloan | 165/30 |
| 5,284,202 | | 2/1994 | Dickey et al. | 165/1 |
| 5,297,731 | * | 3/1994 | Bucceri | 239/2.2 |
| 5,667,137 | | 9/1997 | Dupre | 239/14.2 |
| 6,039,265 | * | 3/2000 | Dupre et al. | 239/14.2 |

* cited by examiner

*Primary Examiner*—Andres Kashnikow
*Assistant Examiner*—Dinh Q. Nguyen
(74) *Attorney, Agent, or Firm*—Carothers & Carothers

(57) ABSTRACT

A snow making tower with a water and air precooling system. An elongated aluminum pipe snow making tower is supported above ground in an upright manner and is provided with snow making nozzles at its upper end for ejecting air and water under pressure into ambient atmosphere for manufacturing snow in subfreezing conditions. Water and air supply connections are provided at the lower end for connection to sources of water and air under pressure. A closed loop antifreeze cooling system is mounted adjacent this tower and includes a radiator, a circulating pump and tubing for continually recirculating antifreeze fluid through the radiator with the pump. This tubing includes metal tubing that passes within the interiors of the aluminum pipe snow making tower for thereby precooking water and air passing through the tower prior to ejection from the snow making nozzles.

7 Claims, 2 Drawing Sheets

SNOW MAKING TOWER WITH ANTIFREEZE PRECOOLING SYSTEM

BACKGROUND OF THE INVENTION

This invention relates generally to the art of fluid sprinkling and more particularly to snow making towers for ski slopes.

The present invention pertains to an improvement in snow making towers of the type disclosed in Dupre U.S. Pat. Nos. 5,360,163 and 5,667,137, which include or incorporate an elongated aluminum pipe system for the tower.

A suitable discussion regarding prior art background of the present invention is presented in these patents and also in the inventor's U.S. Pat. Nos. 3,822,825 and 3,952,949. Accordingly the background provided in these patents is incorporated herein by reference.

Generally, the present invention pertains to snow making towers which are comprised of a vertical support pole and a support arm pivotally connected to the support pole adjacent the upper end thereof for pivotal movement from vertical to horizontal. A snow making tower pipe is secured at its lower end to the support arm and is provided with snow making nozzles at the upper end thereof.

The tower pipe is supported from the support arm for elevating the nozzles above ground with pivotal movement of the support arm toward vertical. Air and water supplies under pressure are connected to the pipe tower at its lower end to provide water and air under pressure to the nozzles at the upper end of the tower pipe for discharge into ambient atmosphere for manufacturing snow in subfreezing conditions.

These afore-described prior art snow making towers generally pertain to the type of towers wherein air and water under pressure are externally mixed in the ambient atmosphere when they are ejected under pressure from respective nozzles at the top of the tower. Other snow making towers intermix the air and water under pressure within the tower pipe and eject the mixture from the snow making nozzles. The present invention will be described in conjunction with the external mixing type snow making tower, but is equally usable with and applicable to internal mixing towers.

A common problem encountered with all the afore described prior art snow making towers is that the water and air being supplied to the tower and ultimately to the snow making nozzles at the top of the tower is warmer than desired. The colder the air and water are which are being supplied to the snow making nozzles at the top of the tower, the more efficient is the snow making operation and a more superior quality snow is manufactured.

It is a principal object of the present invention to provide a snow making tower with superior precooling capabilities for precooling the water and air supplied to the snow making nozzles at the upper end of such a snow making tower.

SUMMARY OF THE INVENTION

The snow making tower of the present invention is provided with a water and air supply precooling system. The tower is comprised of an elongated aluminum pipe snow making tower supported above ground in an upright manner with snow making nozzles at the upper end of the tower pipe for ejecting air and water under pressure into ambient atmosphere for manufacturing snow in subfreezing conditions. Water and air supply connections are provided at the lower end of the tower pipe for connection to sources of water and air under pressure.

In the antifreeze precooling snow making tower of the present invention, a closed loop antifreeze cooling system is mounted adjacent the tower and includes a radiator, a circulating pump and tubing for continually recirculating antifreeze fluid through the radiator by the pump for efficient cooling of the antifreeze fluid. Any suitable antifreeze fluid may be used, such as automobile liquid, radiator antifreeze or R.V. antifreeze.

The tubing utilized in this cooling system includes metal tubing which passes through or within interiors of the aluminum snow making tower pipe for thereby precooling water and air passing upwardly through the tower in an adjacent passage or passages prior to ejection from the nozzles.

The radiator may be provided with a cooling fan in similar fashion to other radiator systems.

For snow making towers which include external mixing of air and water for manufacture of snow, an extruded aluminum tube may be utilized for the tower pipe, which tube has at least three separated conduit passages for segregated flow of air, water and antifreeze fluid therethrough. The antifreeze fluid is preferably circulated from the top of the tower pipe to the bottom. In addition, the tubing portions which lead to the upper end of the snow making tower pipe are preferably positioned and retained along the top edge of the tower pipe.

The tower and the antifreeze cooling system may be combined as a unit and mounted on a towable vehicle for easy mobility.

BRIEF DESCRIPTION OF THE DRAWINGS

Other objects and advantages appear in the following description and claims. The accompanying drawings show, for the purpose of exemplification, without limiting the invention or claims thereto, certain practical embodiments illustrating the principals of this invention wherein:

DETAILED DESCRIPTION OF A PREFERRED EMBODIMENT

Figure 1:
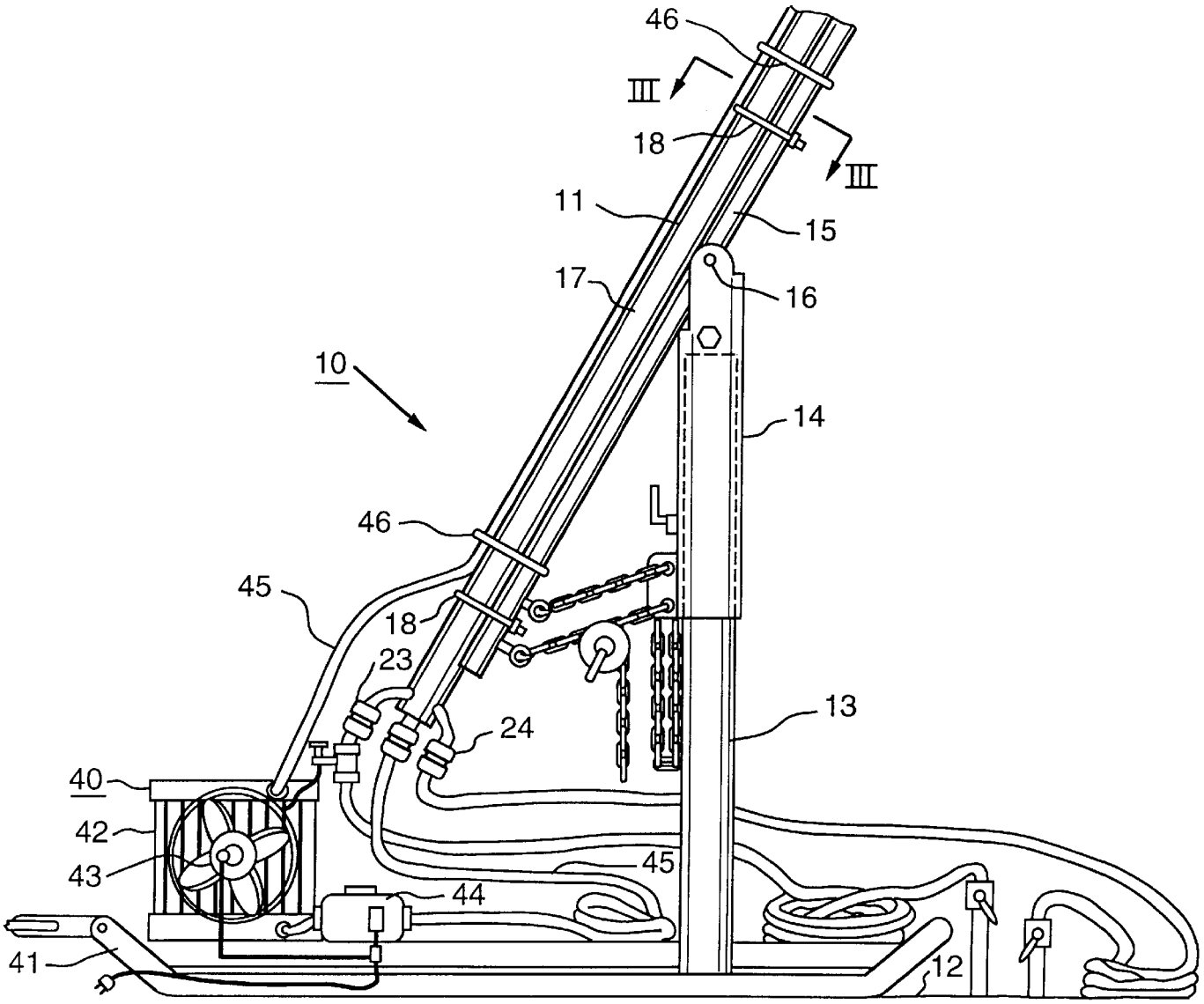
FIG. 1 is a view in side elevation of one embodiment of the snow making tower of the present invention, with the upper end of the tower removed, showing the snow making tower of the present invention having an antifreeze precooling system.
Figure 3:
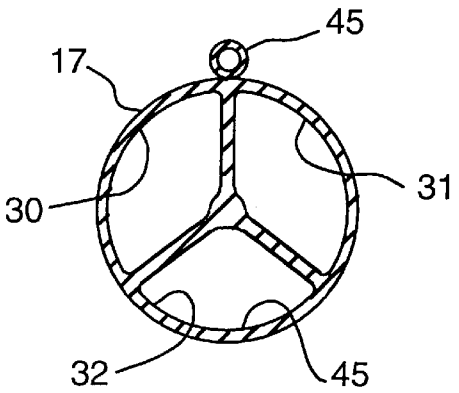
FIG. 3 is a cross sectional view of the tower structure illustrated in FIG. 1 as seen along section line III—III.

Referring to the drawings, the snow making tower 10 of the present invention is illustrated and includes a water and air precooling system.

The tower 10 includes an elongated aluminum pipe snow making tower 11 incorporating an aluminum tower pipe section 17 which is supported above ground 12 in an upright manner as illustrated by a support system which is comprised of a support post 13, a support pipe 14 coaxially received over the upper end of post 13 for axial rotation thereon and an elongated support arm 15 which is pivotally connected for pivotal movement in a vertical plane about pivot bolt 16. The lower end of elongated extruded aluminum tower pipe segment 17 is clamped to support arm 15 by means of stainless steel U-bolt clamps 18 so that it pivots in unison with the support arm.

Snow making nozzles 20 are provided at the upper end of pipe tower 11 for ejecting air and water under pressure into ambient atmosphere for manufacturing snow in subfreezing conditions. While not required to practice the teachings of the present invention, this particular snow making tower structure utilizes external mixing of air and water under pressure through the use of air nozzles 21 and water nozzles 22 as explained in the prior art.

Water and air supply connections 23 and 24 are provided at the lower end of pipe tower 11 for connection to sources of water and air under pressure as indicated.

In this particular embodiment, the extruded aluminum pipe segment 17 is extruded with three separated conduit passages 30, 31 and 32 for segregated flow of air, water and antifreeze fluid therethrough.

Water supplied under pressure thereto is flowed upwardly through passage 30, air is flowed upwardly therethrough through passage 31, and central passage 32 is utilized to flow antifreeze fluid therethrough downwardly from the upper end of the tower 10 to the bottom.

The antifreeze cooling system portion 40 of the snow making tower of the present invention is mounted adjacent the tower 11 on a common towable vehicle, here illustrated in the form of a sled 41. This antifreeze cooling system is a closed loop system which includes radiator 42 cooled with electric air fan 43, an electric circulating pump 44 and tubing 45 for continually recirculating antifreeze fluid within the tubing and the system through radiator 42 with pump 44. The portion of tubing 45 which passes through extruded pipe segment 17 is metal for efficient cooling or heat transfer.

In the present embodiment this metal tubing 45 within extruded pipe segment 17 is part and parcel of the extruded member. However, with other types of prior art towers, which include a single exterior tower pipe, the metal tubing 45 may be separately provided for passing within the interiors of the aluminum pipe snow making tower.

The result of this circulation of antifreeze from the top to the bottom through the tower is to precool the water and air also passing through the tower 11 before being ejected through snow making nozzles 20 to thereby provide the manufacture of better quality snow with more efficiency.

The flow of the antifreeze fluid within the tower 11 may be reversed, but it is considered that the flow as illustrated is more efficient and effective. Similarly, the antifreeze tube 45 which delivers the antifreeze to the top of the tower is preferably positioned on top of the extruded pipe 17 and held in position with elastic stretch cords 46. It is so positioned so that any cooling effect from this portion of the tubing 45 will more efficiently be transferred downwardly to the aluminum pipe segment 17 for additional cooling transfer of heat.

Figure 2:
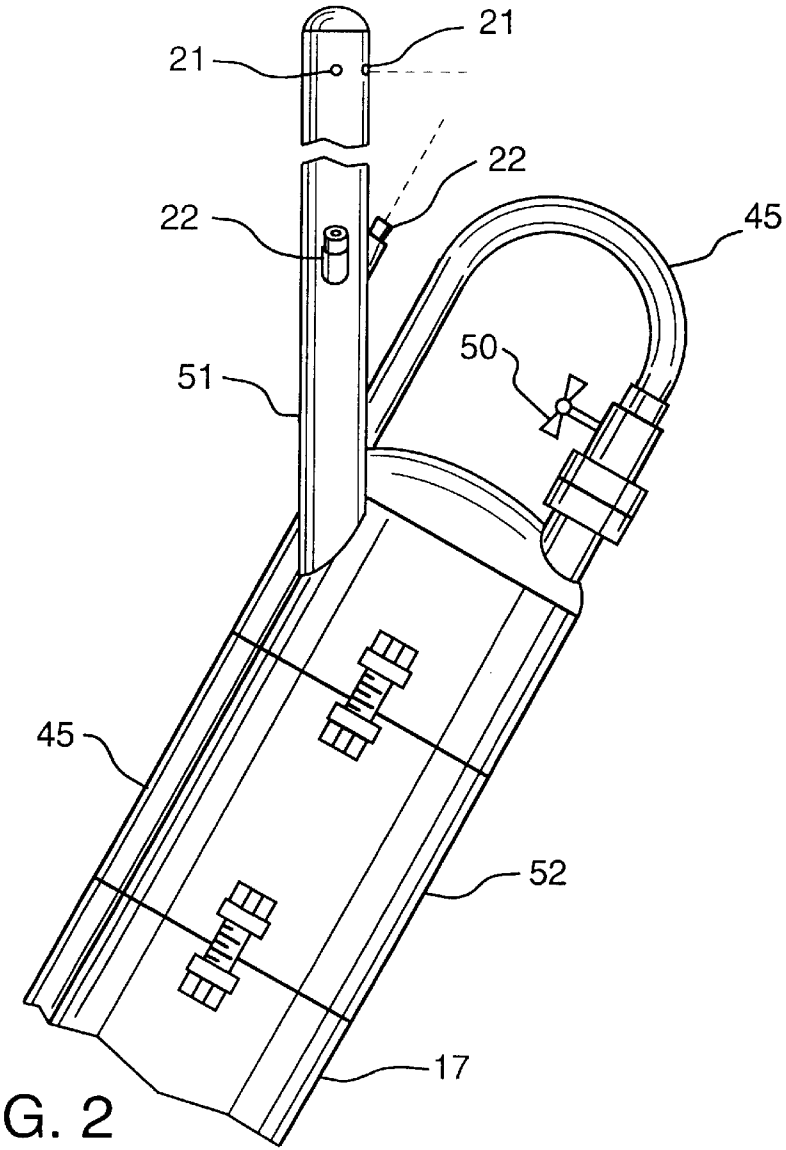
FIG. 2 is a view in side elevation of the upper end of the snow making tower structure shown in FIG. 1 in enlargement.

As is best seen in FIG. 2, the antifreeze fluid delivered upwardly to the top of tower 11 passes through an air bleeder valve 50 on into the top of tower 11 before entering the top of the tower. When the system 40 is initially filled with antifreeze fluid, air may be bled from the system through this bleeder valve 50.

The head 51 of the tower 11 is coupled to the upper end of extruded pipe segment 17 through tube manifold coupler 52, which directs the connection and proper flow of water, air and antifreeze to the required passages as described in order to perform the required functions of the tower 10. These segments of the head 51 are bolted together as illustrated.

I claim:

1. A snow making tower having a water and air precooling system comprising:

an elongated aluminum pipe snow making tower supported above ground in an upright manner and having upper and lower ends with snow making nozzles at the upper end for ejecting air and water under pressure into ambient atmosphere for manufacturing snow in subfreezing conditions, and water and air supply connections at the lower end for connection to sources of water and air under pressure;

a closed loop antifreeze cooling system mounted adjacent said tower and including a radiator, a circulating pump and tubing for continually recirculating antifreeze fluid through said radiator with said pump; and said tubing including metal tubing passing within interiors of said aluminum pipe snow making tower for thereby precooling water and air passing therethrough prior to ejection form said nozzles.

2. The snow making tower of claim 1 wherein said tower and said antifreeze cooling system are mounted on a towable vehicle.

3. The snow making tower of claim 1 wherein said snow making nozzles include separate air and water nozzles for external mixing of water and air under pressure.

4. The snow making tower of claim 3 wherein said tower includes an extruded aluminum tube having at least three separated conduit passages for segregated flow of air, water and antifreeze fluid therethrough.

5. The snow making tower of claim 1 wherein said cooling system circulates antifreeze fluid in said tubing from the upper end of said tower to the lower end.

6. The snow making tower of claim 5 wherein said tubing has portions leading to the upper end of the tower which are positioned along an upper edge of said tower.

7. The snow making tower of claim 1 wherein said closed loop antifreeze cooling system includes a cooling fan for said radiator.

* * * * *